US008978295B2

(12) United States Patent
Bard et al.

(10) Patent No.: US 8,978,295 B2
(45) Date of Patent: Mar. 17, 2015

(54) SELF-ACTUATING STAND AND METHODS THEREOF

(76) Inventors: Robert Alan Bard, Loveladies, NJ (US); Douglas Aaron Bard, Brielle, NJ (US)

( * ) Notice: Subject to any disclaimer, the term of this patent is extended or adjusted under 35 U.S.C. 154(b) by 0 days.

(21) Appl. No.: 13/200,884

(22) Filed: Oct. 4, 2011

(65) Prior Publication Data

US 2012/0102830 A1 May 3, 2012

Related U.S. Application Data

(60) Provisional application No. 61/455,397, filed on Oct. 20, 2010.

(51) Int. Cl.
*A47G 33/12* (2006.01)

(52) U.S. Cl.
CPC ..... *A47G 33/1206* (2013.01)
USPC ..... 47/42; 47/39

(58) Field of Classification Search
USPC ..... 47/32.4, 32.5, 39, 40.5, 42, 43; 248/523, 526, 524, 511, 312, 539, 248/316.2, 316.3, 346.04, 314
See application file for complete search history.

(56) References Cited

U.S. PATENT DOCUMENTS

| | | | | |
|---|---|---|---|---|
| 3,693,918 | A * | 9/1972 | Fisher et al. | 47/40.5 |
| 4,676,471 | A * | 6/1987 | Moore | 248/526 |
| 4,834,335 | A * | 5/1989 | Attar | 248/526 |
| 4,949,502 | A * | 8/1990 | Anderson | 47/40.5 |
| 5,114,113 | A * | 5/1992 | Krinner | 248/525 |
| 5,797,579 | A * | 8/1998 | Krinner | 248/523 |
| 7,484,703 | B2 * | 2/2009 | Krinner | 248/519 |
| 7,494,026 | B2 | 2/2009 | Bard et al. | |
| 2003/0084607 | A1 | 5/2003 | Cone | |
| 2007/0012851 | A1 * | 1/2007 | Krinner | 248/524 |

* cited by examiner

*Primary Examiner* — Rob Swiatek
*Assistant Examiner* — Lisa Tsang
(74) *Attorney, Agent, or Firm* — Michael P. Kochka, Esq.

(57) ABSTRACT

A self-adjusting, self-actuating and clamping apparatus employing only non-elastic material parts for vertically or approximately vertically and also downwardly securing Christmas trees or, more generically, other items configured similar to the Christmas tree trunk, to be secured vertically or approximately vertically and downwardly such that in the specific case of the Christmas tree the apparatus can accommodate various sized tree trunks as well as various peripherally/externally configured tree trunks. More specifically, when the apparatus is employed to secure a Christmas tree, or other items configured similar to the Christmas tree trunk, the stability of the Christmas tree, or other items configured similar to the Christmas tree trunk, is increased. In addition, the apparatus can be mounted on a turn-table so as to facilitate the process of decorating the Christmas tree.

11 Claims, 4 Drawing Sheets

SELF-ACTUATING STAND AND METHODS THEREOF

The present invention claims priority from the U.S. provisional patent application Ser. No. 61/455,397 filed on Oct. 20, 2010 entitled "A self adjusting, self-actuating and clamping stand employing only non-elastic material parts for securing items in the vertical or approximately vertical and the downward position, as in the case addressed herein as an example, that being the case of the "EZ Christmas Tree Stand", as it is registered and displayed in the video seen at the following web address/URLs: www.ezxmastreestand.com and www.ezchristmastreestand.com. The present invention relates generally to devices which vertically or approximately vertically secure Christmas trees or like items.

The present invention is based on as well as a derivative of our related patent #U.S. Pat. No. 7,494,026 B2, which was invented by us, Robert Alan Bard and Douglas Aaron Bard.

BACKGROUND OF INVENTION

There are many existing Christmas tree stands, however, all of them require first placing the Christmas tree trunk into the Christmas tree stand and then completing another action such as tightening screws or pumping an item to put locking pressure on the Christmas tree trunk. This present invention is the first Christmas tree stand where, in and of itself, only the single separate action/act of placing the Christmas tree trunk into the Christmas tree stand automatically puts locking pressure on the Christmas tree trunk. The present invention, in addition to acting as a Christmas tree stand can also be utilized to secure other items generically configured similar to the Christmas tree trunk.

BRIEF SUMMARY OF INVENTION

It is an object of the present invention to provide a self-adjusting, self-actuating and clamping apparatus for vertically or approximately vertically and also downwardly securing Christmas trees or, more generically, other items configured similar to a Christmas tree trunk, to be secured vertically or approximately vertically and downwardly such that in the specific case of the Christmas tree the apparatus can accommodate various sized tree trunks as well as various peripherally/externally configured tree trunks. More specifically, when the apparatus is employed to secure a Christmas tree, or other items configured similar to a Christmas tree trunk, the stability of the Christmas tree or other items configured similar to the Christmas tree trunk is increased as follows; the apparatus extends the distance from the center of gravity of the secure Christmas tree, or other items configured similar to a Christmas tree trunk, further outward to the outboard edge of the apparatus which can, in addition, be mounted on a turn-table so as to facilitate the process of decorating the Christmas tree.

DETAILED DESCRIPTION OF INVENTION

Figure 1:
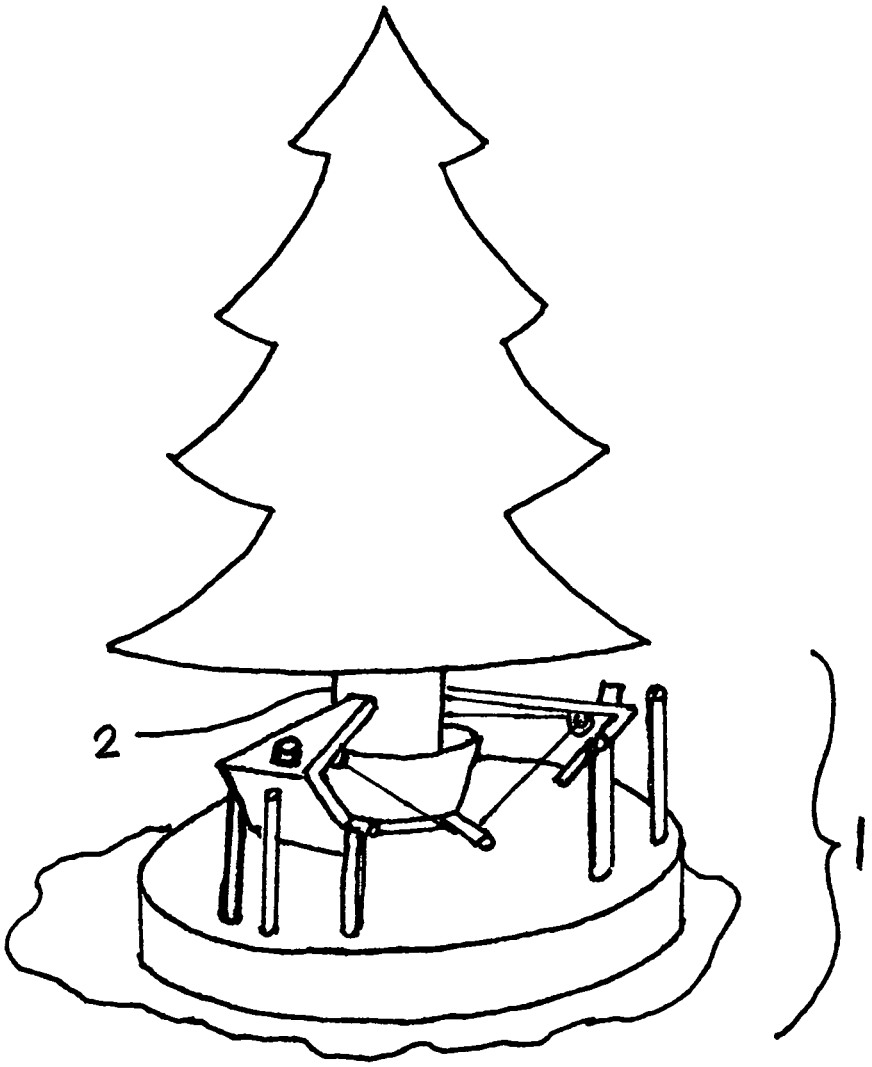
FIG. 1 is a view of the apparatus sitting on the ground/floor with a Christmas tree installed in the apparatus.

The preceding feature and advantages of the present invention will become apparent with the reference to the following detailed description taken in conjunction with the accompanying drawings in which:

FIG. 1 is a view of the apparatus 1 sitting on the ground or a floor with, as an example, a Christmas tree trunk 2 installed in apparatus 1. The apparatus 1 is designed to be located on any relatively flat surface such as the ground or a floor.

Figure 2:
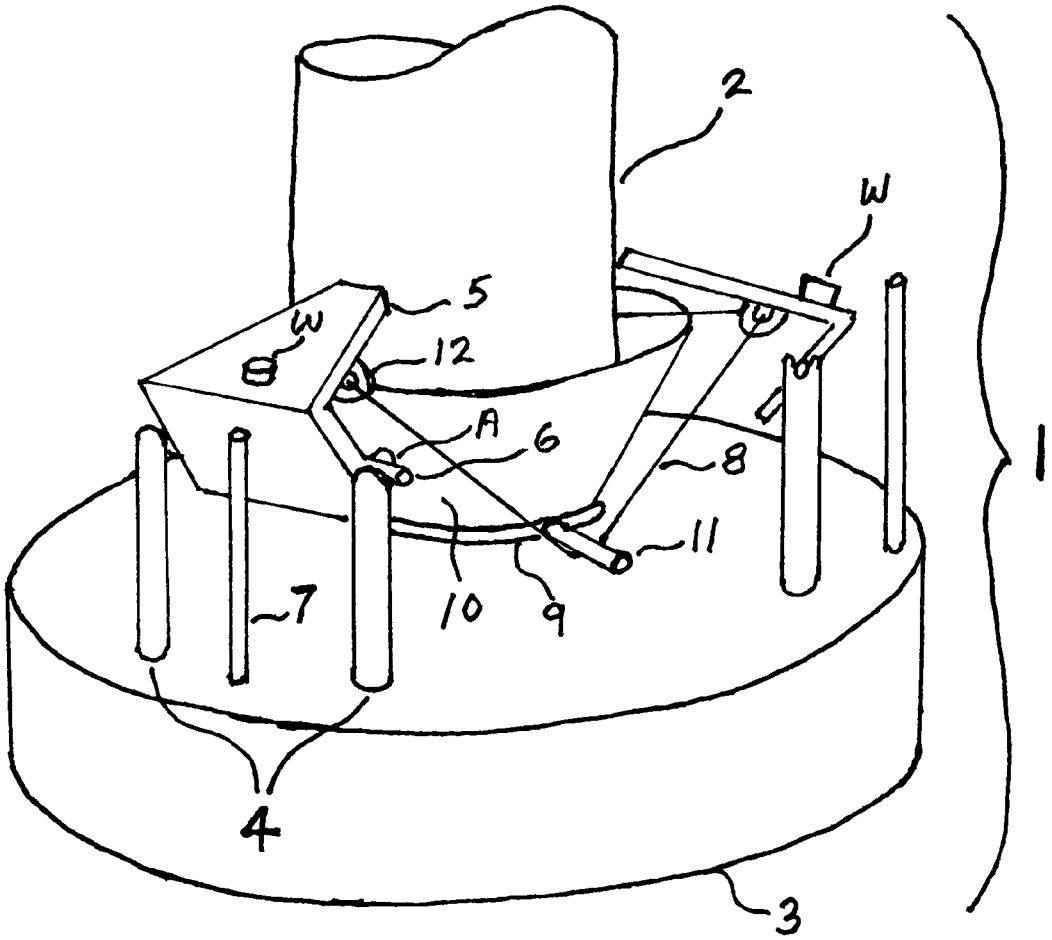
FIG. 2 is an enlarged view of the Christmas tree trunk, the apparatus's base, two of the three sets of dual vertical stanchion assemblies, their associated jaw members with their associated counter weights, pivot pins, hollow open ended conduits and rotation stops and the moveable platform with its extension arm and inverted hollow circular or non circular cone or container and the tightened tensioning non-elastic, yet flexible, line passing through the hollow opened conduit so as to cause each single jaw member to automatically and independently self-adjust to press with equal pressure/force against anywhere on the Christmas tree trunk independent of the eternal peripheral configuration on the surface of the Christmas tree trunk by virtue of the uniform tension along the entire length of the non-elastic, yet flexible, tensioning line.

FIG. 2 is an enlarged view of only the apparatus 1 showing only the Christmas tree trunk 2 installed in the apparatus. The apparatus 1 is composed of the following: A base 3 which serves as a mounting platform for three sets of dual vertical stanchion assemblies 4 each set of which are positioned 120 degrees apart with each individual vertical stanchion 4 being grooved/slotted A at its top to support the jaw member 5 via the pivot pins 6 that perpendicularly protrude from each side of the single jaw member 5. The portion of the jaw member 5 which contacts the Christmas tree trunk 2 can be straight, pointed, or concave as viewed from above. The foregoing configuration allows each jaw member 5 to rotate about the singular/common axis of the pivot pins 6. The rotation is stopped either by the exterior surface of the Christmas tree trunk 2 thus clamping on the exterior surface of the Christmas tree trunk 2 or by the outboard rotational stop 7. Because the three sets of dual vertical stanchion assemblies 4 are positioned 120 degrees apart, FIG. 2 shows two of the three sets of dual vertical stanchion assemblies 4. As detailed later, it is the variable clamping action of the jaw members 5 which can laterally hold variably sized Christmas trees in place via the Christmas tree trunk 2.

It should be noted that by virtue of the way each jaw member 5 is counter balanced by weight W, the upper end of each of the three jaw members 5 initially rests against their associated rotation stop 7 (the position for the initial acceptance of the Christmas tree trunk 2) before the upper end of each jaw member 5 is caused to rotate towards the Christmas tree trunk 2 via the uniform tension which induces/transfers/transmits uniform force on/to the upper end of each jaw member 5 when the closed-loop non-elastic, yet flexible, tensioning line 8, made from flexible material, is drawn tighter per the following sequence:

As the Christmas tree trunk 2, via the weight of the installed Christmas tree, pushes down on the movable platform 9 via it's attached, inverted, hollow and circular or non circular cone or container 10 which is mounted to the top surface of the moveable platform 9, such that the center axis of the inverted, hollow and circular or non circular cone or container 10 is coincident with the center axis of the moveable platform 9, the Christmas tree trunk 2 in turn also pushes down the extension arm 11 which is attached in a radial fashion outward from the periphery of the moveable platform 9 in the plane parallel to both the upper and lower surfaces of the base 3 such that the extension arm 11 in turn moves down and pushes downward on the closed-loop, non-elastic yet flexible tensioning line 8, which passes through all three hollow open ended conduits 12 (one hollow open ended conduit 12 per each jaw member 5) each mounted on the inner surface (facing the center of the apparatus 1) of each jaw member 5 such that there is less length of the closed-loop non-elastic, yet flexible, tensioning line 8 left in the plane established by the three hollow open ended conduits 12 (geometry wise, a plane can always be made to pass through any three points/locations) thus drawing the three hollow open ended conduits 12 and their three associated jaw members 5 closer together in advance of each of the three jaw members 5 independently and automatically self-adjusting to clamp with equal pressure/force anywhere on the Christmas tree trunk 2 (the uniform tension in the closed-loop non-elastic, yet flexible, tensioning line 8 induces an equal force being transmitted to each of the jaw members 5 which in turn transmit that force to the Christmas tree trunk 2 independent of where the jaw members 5 make contact with the Christmas tree 2). The dual purpose of the inverted, hollow and circular or non circular cone or container 10 is to be capable of both accepting and centering the bottom of the Christmas tree trunk 2 within the confines of the inverted hollow and circular or non circular cone or container 10. Thus, there exists 2 separate vertical locations to provide lateral constraint for the Christmas tree trunk 2 separate from the downward constraint also provided by the inverted, hollow and circular or non circular cone or container 10.

Figure 3:
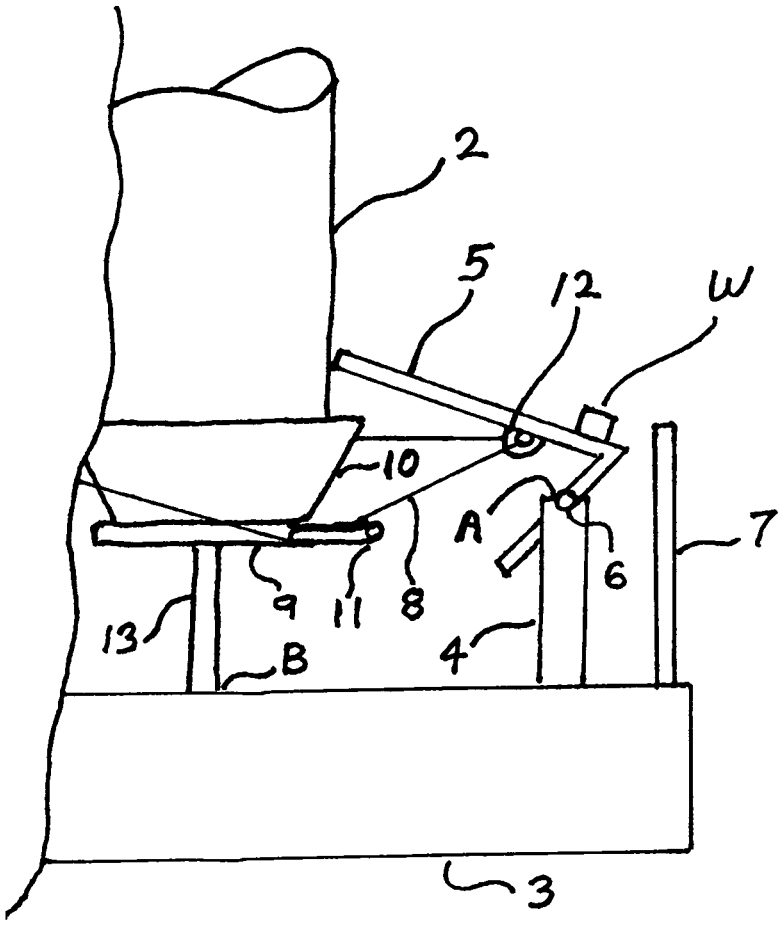
FIG. 3 is a cut-a-way view of the apparatus showing only the Christmas tree trunk installed in the apparatus, including all the items shown in FIG. 2 plus the rod attached to the center underside of the moveable platform.

FIG. 3 is a cut-a-way view of everything shown in FIG. 2 plus the moveable platform 9 attached at its center underside to a rod 13 which is perpendicular to both the top and bottom surfaces of the movable platform 9 and which rides up and down in a hole B which is perpendicularly drilled entirely through the rigid main base 3 thus insuring that both the top and bottom surfaces of the moveable platform 9 will always be parallel to the top and bottom surfaces of the rigid base 3.

Figure 4:
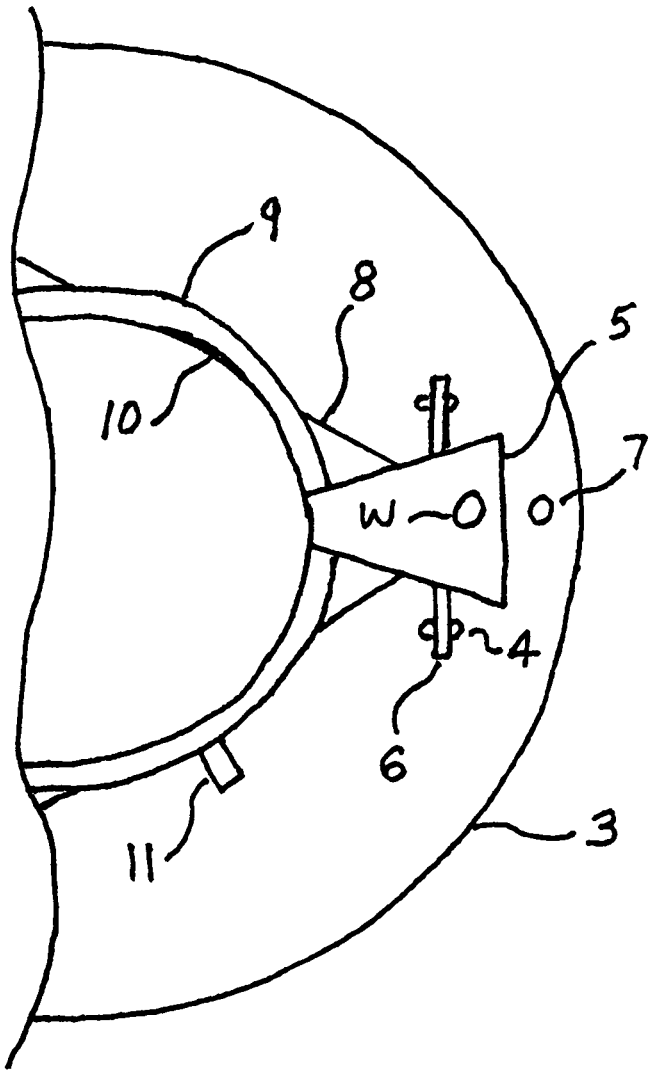
FIG. 4 is a top view of FIG. 3

FIG. 4 is a top view of FIG. 3.

What we claim our invention is:

1. A tree stand for receiving a lower portion of a trunk of a tree, the tree stand comprising:

a receiving part comprising a truncated cone having an upper and a lower surface, the receiving part for receiving the lower portion of the trunk of the tree coaxially with an axis of the receiving part;

a plurality of retaining elements arranged about the axis of the receiving part;

a tensioning device connected to the receiving part, the tensioning device comprising a vertically movable platform having a top surface, the top surface attached to the receiving part, wherein a center axis of the cone is coincident with a center axis of the movable platform, the vertically movable platform comprising a side portion, the side portion attached to a plurality of extension arms, the extension arms mounted radially outward from the side portion of the movable platform in a plane substantially parallel to both the upper and lower surfaces of the receiving part; and tensioning line comprising a flexible connector loadable by tension, the tensioning line operatively connecting the tensioning device to the retaining elements to move each of the retaining elements from a release position wherein the trunk of the tree is not retained by the retaining elements, to a locking position wherein the retaining elements fully engage the trunk of the tree and securely clamp the trunk of the tree with force to substantially prevent realignment of the trunk of the tree when the tree is disposed in the receiving part;

wherein when a lowermost portion of the trunk of the tree is placed into the cone, an interior portion of the cone centers the lowermost portion of the trunk of the tree within the cone and laterally constrains the lowermost portion of the trunk of the tree; and wherein a weight of the tree pushing downward on the platform moves the extension arms downward, wherein the extension arms pull down on the tensioning line thereby tightening the tension on the tensioning line and drawing the retaining elements toward the trunk of the tree and substantially locking the tree in place.

2. The tree stand of claim 1, wherein the tensioning line comprises a closed loop of non-elastic material.

3. The tree stand of claim 1, wherein the tensioning line is non-elastic in a direction of the tensioning with which it is loaded.

4. The tree stand of claim 1, wherein the vertically movable platform comprises a bottom surface, the bottom surface attached to a rod having an axis coaxial to the center axis of the platform, and the rod is disposed perpendicular to a flat plane of the bottom surface of the platform, the rod disposed in a hole in a base, the hole for restricting a lateral movement of the rod.

5. The tree stand of claim 1, wherein the plurality of retaining elements collectively comprise a triangular assembly for engaging the trunk of the tree, each of the plurality of retaining elements of the triangular assembly having a rotational axis substantially orthogonal to the axis of the receiving part.

6. The tree stand of claim 5, wherein each of the plurality of retaining members of the triangular assembly is pivotably mounted on a plurality of stanchion assemblies comprising at least two stanchions extending upward from the base, wherein the triangular assembly provides a three point contact spaced 120 degrees apart; and wherein an upper end of each of the plurality of retaining elements is adapted to contact an outside portion of the trunk of the tree, thereby laterally securing the trunk of the tree at a location above lowermost portion of the trunk of the tree.

7. The tree stand of claim 1, wherein each retaining element comprises a counter balancing weight, each counter balancing weight causing each retaining element to rotate outward from the center of the receiving part to pull the tensioning line up to the release position.

8. The tree stand of claim 4, further comprising at least three rotational stops projecting upward from the base, the rotational stops adapted to stop each retaining element, after each retaining element has rotated away from the center of the tree stand, each retaining element in a position for receiving the lower portion of the trunk of the tree, thereby preventing an upper portion of each of the retaining elements from rotating outboard from the center of gravity of the tree stand to the extent that the rod would be lifted completely out of the hole.

9. The tree stand of claim 4, wherein the rod comprises a stop attached to a bottom portion of the rod to prevent the rod from being shifted completely out of the hole.

10. The tree stand of claim 1, wherein the tree stand is mounted on a turn table so as to facilitate rotating the tree for ease of decoration.

11. A tree stand for receiving a lower portion of a trunk of a tree comprising:

a receiving part for receiving the lower portion of the trunk of the tree coaxially with a center axis of the receiving part;

a plurality of retaining elements arranged about the axis;

a counter weight disposed on each of the plurality of retaining elements;

a tensioning device connected to the receiving part, the tensioning device comprising a vertically movable platform having a top surface, the top surface attached to the receiving part, wherein the center axis of the receiving part is coincident with a center axis of the movable platform, the vertically movable platform comprising a side portion, the side portion attached to a plurality of extension arms, the extension arms mounted radially outward from the side portion of the movable platform; and a tensioning line operatively connecting the tensioning device to the plurality of retaining elements to move the retaining elements from a release position, wherein the trunk of the tree is not retained by the retaining elements, to a retaining position, wherein the retaining elements securely clamp the trunk of the tree with force to substantially prevent realignment of the trunk of the tree in the receiving part, the tensioning line comprising a flexible connecting device is loadable by tension, the tensioning device being coaxially movable with respect to the axis of the receiving part, such that when the tension is applied to the tensioning line by the tensioning device, the tensioning device moves coaxially with respect to the axis of the receiving part against a force applied by each counterweight on the respective retaining elements.

* * * * *